US010913597B1

(12) United States Patent
Claeys

(10) Patent No.: US 10,913,597 B1
(45) Date of Patent: Feb. 9, 2021

(54) COLLAPSIBLE FRAME FOR A LIQUID STORAGE TANK WITH VARIABLE CAPACITY

(71) Applicant: Jay V. Claeys, Bartlesville, OK (US)

(72) Inventor: Jay V. Claeys, Bartlesville, OK (US)

( * ) Notice: Subject to any disclaimer, the term of this patent is extended or adjusted under 35 U.S.C. 154(b) by 0 days.

(21) Appl. No.: 15/996,133

(22) Filed: Jun. 1, 2018

Related U.S. Application Data

(63) Continuation of application No. 14/257,707, filed on Apr. 21, 2014, now abandoned.

(60) Provisional application No. 61/815,143, filed on Apr. 23, 2013.

(51) Int. Cl.
*B65D 88/52* (2006.01)

(52) U.S. Cl.
CPC ..... *B65D 88/522* (2013.01)

(58) Field of Classification Search
CPC .... B65D 90/205; B65D 90/24; B65D 88/005; B65D 21/08; B65D 7/26; B65D 81/3261; B65D 88/16; E04H 4/0056; E04H 15/48
USPC ..... 220/9.2, 4.29, 4.16, 4.34, 9.4, 6
See application file for complete search history.

(56) References Cited

U.S. PATENT DOCUMENTS

| | | | | |
|---|---|---|---|---|
| 2,567,514 | A * | 9/1951 | Hoffman | A61G 7/0005 4/587 |
| 4,184,602 | A | 1/1980 | Moliard | |
| 5,544,446 | A * | 8/1996 | Benson, Jr. | A01G 9/12 220/6 |
| 7,661,558 | B2 * | 2/2010 | De Laforcade | B65D 75/5811 132/209 |
| 2010/0140263 | A1 | 6/2010 | Claeys | |
| 2012/0241448 | A1 * | 9/2012 | Claeys | B65D 90/205 220/9.2 |
| 2013/0186890 | A1 | 7/2013 | Moody | |

* cited by examiner

*Primary Examiner* — Shawn M Braden
(74) *Attorney, Agent, or Firm* — Frank J. Catalano; Gable Gotwals

(57) ABSTRACT

A collapsible frame for a liquid holding tank is provided. The frame has orthogonal upper and lower rails spaced by vertical struts. The upper and lower rails have hinges at each corner thereof and orthogonally aligned hinges at midpoints and quarterpoints of two opposed sides thereof. The frame can be expanded or collapsed between a fully expanded and a fully collapsed condition by operation of the midpoint hinges and corner hinges. The frame can be expanded or collapsed between a fully expanded and a semi-expanded condition by operation of either the quarterpoint and corner hinges or the midpoint, quarterpoint, and corner hinges. The fully collapsed condition is primarily designed for storage, the semi-expanded condition allows the size of the tank to be reduced to accommodate site constraints, and the fully expanded condition maximizes the tank's liquid storage capacity.

3 Claims, 6 Drawing Sheets

COLLAPSIBLE FRAME FOR A LIQUID STORAGE TANK WITH VARIABLE CAPACITY

REFERENCE TO PENDING APPLICATIONS

This application is a continuation application claiming priority to U.S. patent application Ser. No. 14/257,707 filed Apr. 21, 2014 and to Provisional Patent Application No. 61/815,143 filed Apr. 23, 2013.

BACKGROUND OF THE INVENTION

This invention relates generally to liquid storage tanks and more particularly concerns portable tanks for storing water to be used in emergency situations, such as fighting fires.

It is a common practice to use portable water storage tanks in fighting fires where no natural reservoir is available. It is often desirable and sometimes critical that the portable tanks be rapidly collapsed for removal, either because the fire-fight is ended or because the tank needs to be relocated to a different site to fight the same or a different fire. In addition, the size or topography of the staging area may limit the amount of space where the tank can be placed. For example, a narrower tank may be required so that there is room to move vehicles and equipment around the tank.

Conventionally, this problem has been addressed by deploying a different tank with a shorter width. However, reducing the width of the tank also decreases tank capacity. As a result, multiple smaller tanks may be required to provide the necessary quantity of liquid. Multiple tanks are a disadvantage in an emergency situation because workers need additional time to set up the tanks and break them down, diverting their attention from the fire-fight. In addition, firefighting trucks or other vehicles must carry tanks in multiple sizes. Workers must evaluate each specific situation to determine which size of tank to deploy and risk not having enough tanks of the correct size. Having multiple tanks of different sizes also increases cost as well as storage, maintenance, inspection, and repair requirements.

It is, therefore, an object of this invention to provide a collapsible frame for a portable liquid storage tank that allows the tank to be deployed in either a fully expanded or semi-expanded condition and then rapidly collapsed. Varying the size of the tank maximizes liquid storage capacity while accommodating site constraints. It is also an object of this invention to facilitate the placement and folding of the tank. It is also an object of this invention to eliminate the need for multiple tanks of different sizes, thus facilitating emergency response.

SUMMARY OF THE INVENTION

In accordance with the invention, a collapsible frame for a liquid holding tank is provided. The frame has orthogonal upper and lower rails spaced by vertical struts. The upper and lower rails have hinges at each corner thereof and orthogonally aligned hinges at midpoints and quarterpoints of two opposed sides thereof. The frame is expandable and collapsible by operation of said corner hinges and midpoint hinges between a fully collapsed condition and a fully expanded condition. The frame is expandable and collapsible between the fully expanded condition and the semi-expanded condition by operation of the quarterpoint hinges and corner hinges or by operation of the midpoint hinges, quarterpoint hinges, and corner hinges.

A method for collapsing and expanding a collapsible frame for a liquid holding tank is also provided. The method includes the steps of identifying a condition in which the tank should be deployed and operating the quarterpoint and corner hinges, or the midpoint, quarterpoint, and corner hinges, of the frame to place the tank in the identified condition. The method also includes the step of operating the midpoint hinges and corner hinges of the frame to place the tank in the fully collapsed condition.

BRIEF DESCRIPTION OF THE DRAWINGS

Other objects and advantages of the invention will become apparent upon reading the following detailed description and upon reference to the drawings in which.

Figure 1:
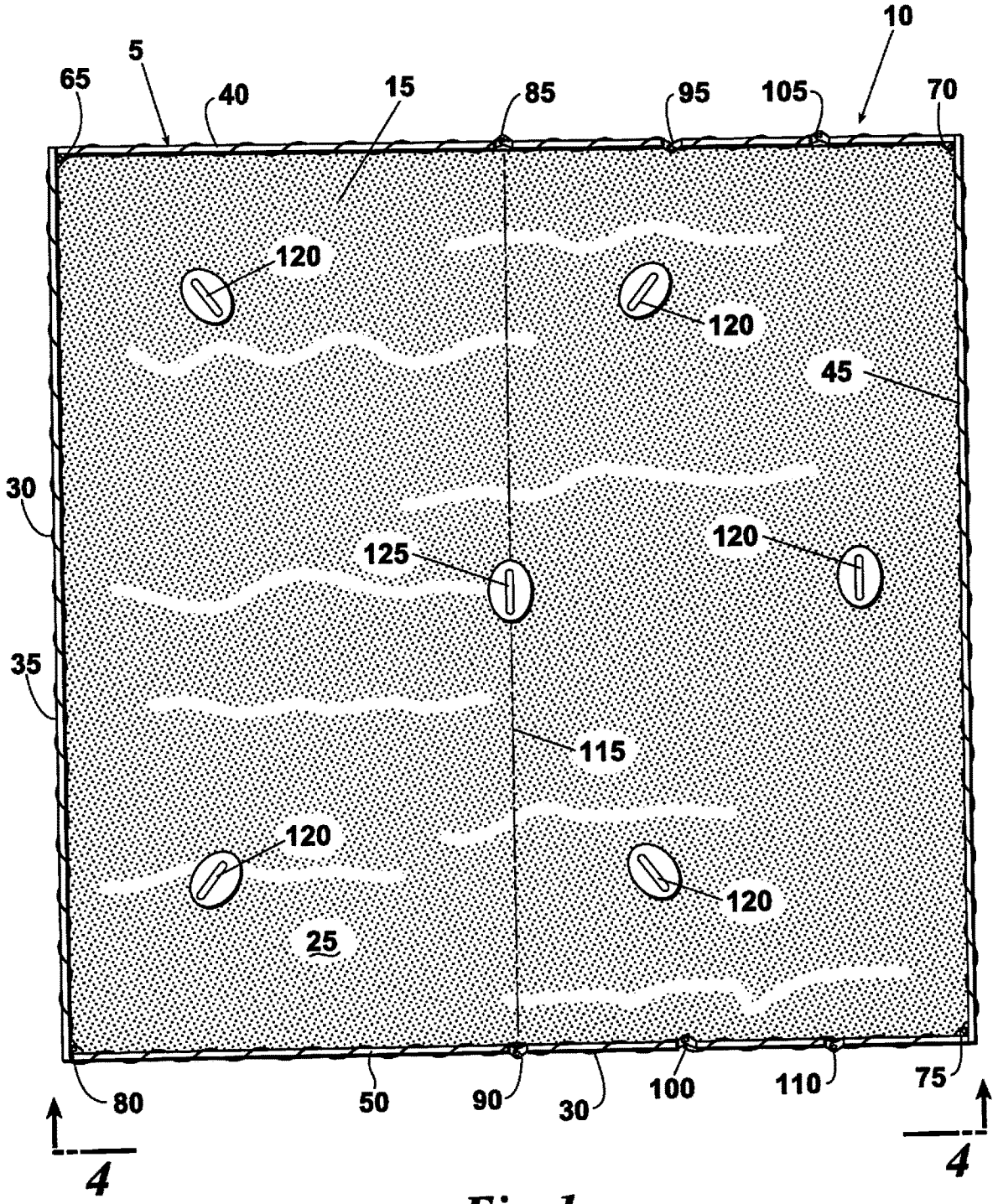
FIG. 1 is a top plan view of a preferred embodiment of the collapsible frame for a liquid holding tank in the fully expanded condition.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Referring to FIGS. 1-8, a preferred embodiment of a collapsible frame 5 for a liquid holding tank 10 is illustrated. Such tanks are typically, though not necessarily, square. They are usually about 30 inches high, from 6 feet to 18 feet on each side, and hold from 500 gallons to 5,000 gallons of water.

The tank liner 15 is preferably made using PVC vinyl, but any material impervious to the liquid to be stored can be used. The tank liner 15 has side walls 20 and a floor panel 25. The floor panel 25, which will be subjected to greater stress and abuse, is made of material heavier than the material of the side walls 20. For example, for water storage tanks the floor panel may be of 28-ounce to 40-ounce PVC vinyl while the side walls can be of significantly lighter material. It is preferred that the perimeter of the floor panel 25 overlap the edge of the side walls 20 and that the floor panel 25 and side walls 20 be heat sealed along the entire perimeter of the floor panel 25.

The upper perimeter of the side walls 20 of the tank liner 15 may be doubled over and sewn for strength and fitted with grommets. A cord 30 may be laced around the upper rails and through the grommets so that the side walls 20 of the tank liner 15 are supported by the upper rails of the collapsible frame 5. For example, #4 solid brass grommets on 6-inch centers have been found to work satisfactorily.

The side walls 20 of the tank liner 15 are supported by a collapsible frame 5. The collapsible frame 5 consists of upper rails 35, 40, 45, 50 and lower rails (one lower rail 55 shown) spaced apart by vertical struts 60. The collapsible frame 5 may be constructed, for example, using 1 inch by 1⅛ inch square aluminum tube or ⅞ inch by 14 gage round steel pipe, MIG welded as necessary, for the rails and struts. Tanks having frames of such components can be folded to a thickness of approximately 7 inches.

The upper and lower rails 35, 40, 45, 50, 55 have hinges 65, 70, 75, 80 at each corner thereof to connect the rails of the collapsible frame 5. Two opposing sets of upper rails 40, 50 and lower rails also have orthogonally aligned midpoint hinges 85, 90 and quarterpoint hinges 95, 100, 105, 110. The midpoint hinges 85, 90 define a vertical plane 115 approximately bisecting the liquid holding tank 10. The remaining sets of upper rails 35, 45 and lower rails do not have hinges at the midpoints or quarterpoints.

Figure 7:
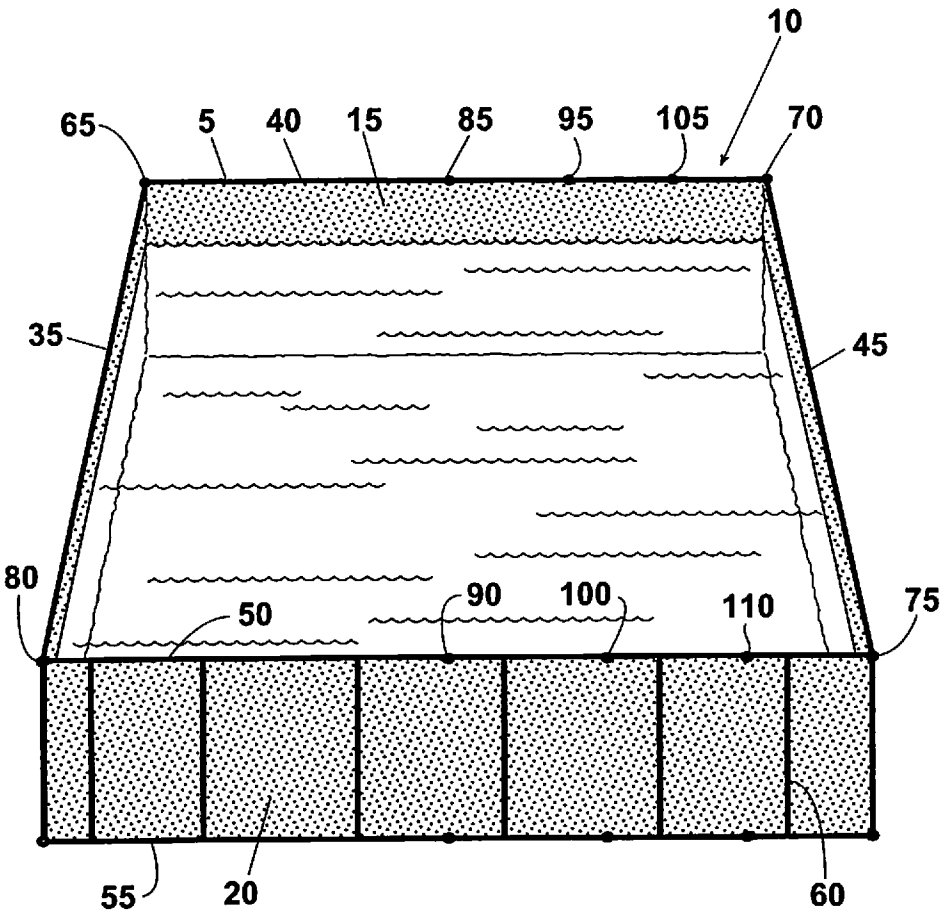
FIG. 7 is a top perspective view of a preferred embodiment of a liquid holding tank with the collapsible frame in the fully expanded condition and liquid in the tank.

Referring to FIGS. 1 and 7, when the collapsible frame 5 is in the fully expanded condition, the midpoint hinges 85, 90 and quarterpoint hinges 95, 100, 105, 110 are oriented so that the rail sections on either side of the midpoint hinges 85, 90 and quarterpoint hinges 95, 100, 105, 110 are straight and are perpendicular to the vertical plane 115. This orientation straightens the hinged rails 40, 50, which maximizes the length of the hinged rails 40, 50 as well as the length of the side walls 20 supported by those rails. Therefore, the tank 10 is at its largest size and has its maximum capacity for liquid storage.

Figure 2:
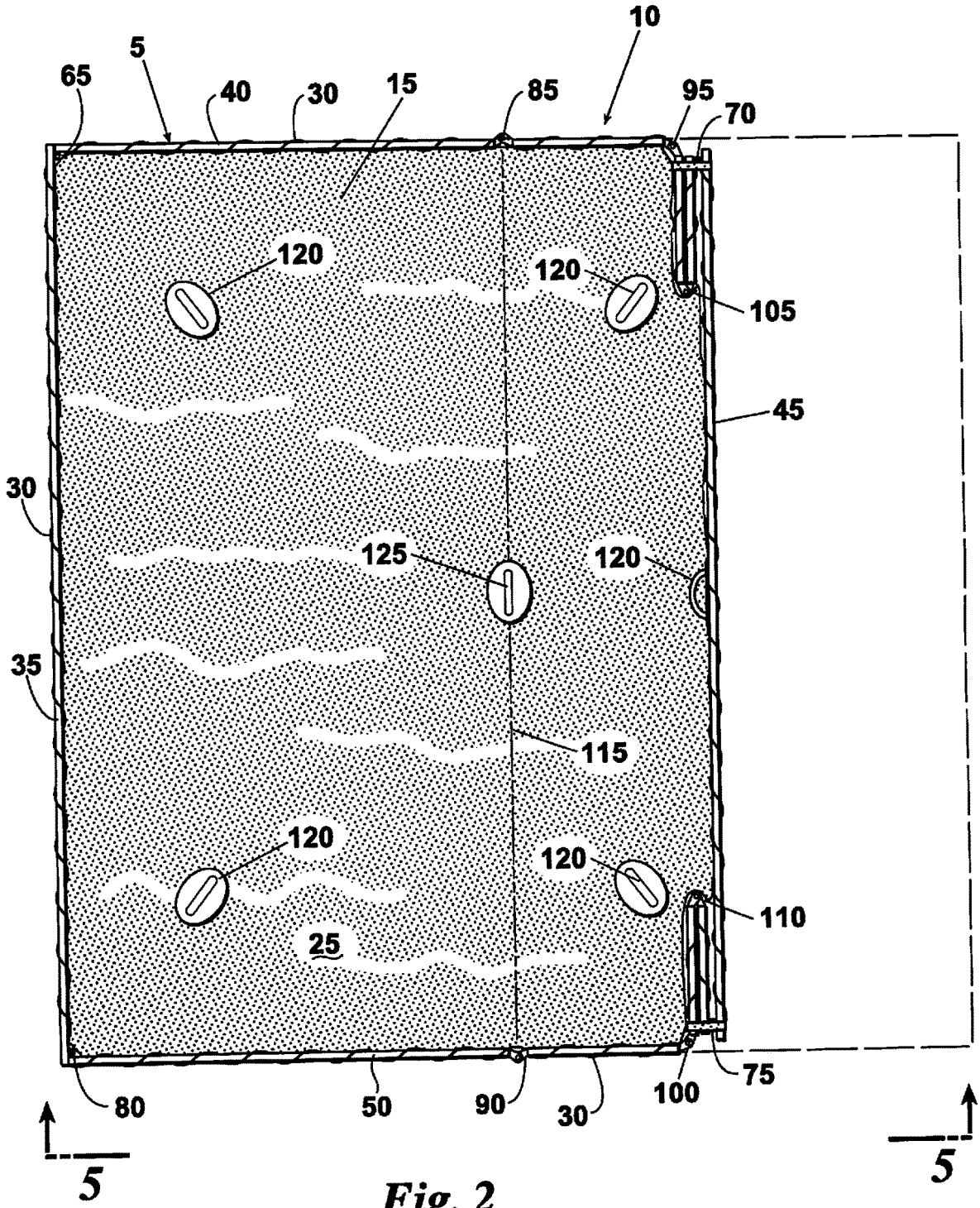
FIG. 2 is a top plan view of a preferred embodiment of the collapsible frame for a liquid holding tank in the semi-expanded condition.
Figure 8:
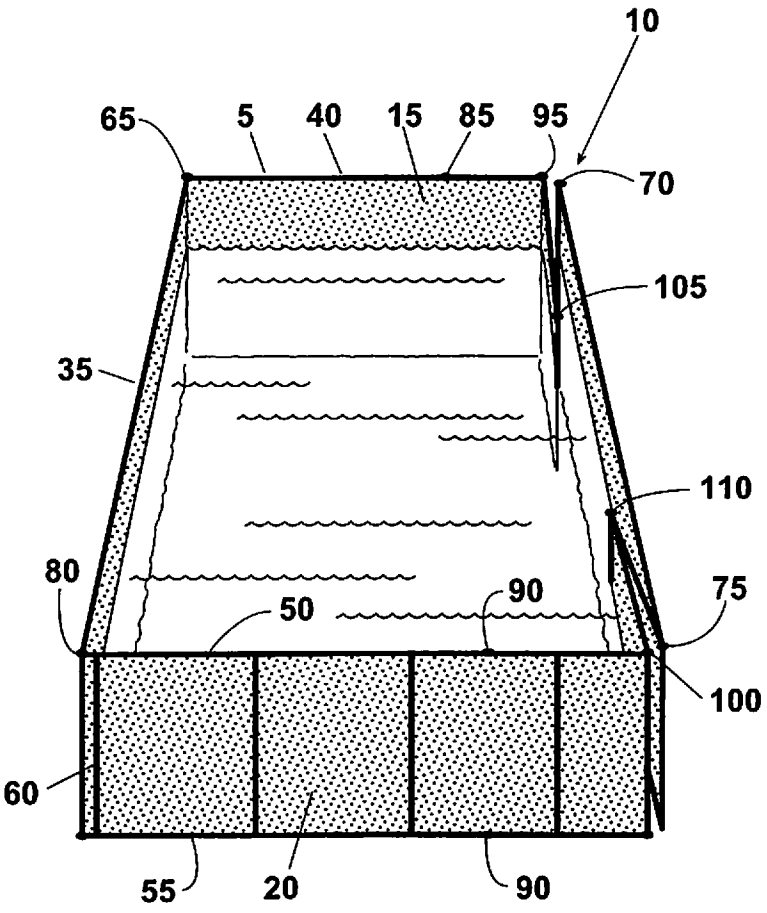
FIG. 8 is a top perspective view of a preferred embodiment of a liquid holding tank with the collapsible frame in the semi-expanded condition and liquid in the tank.

Referring to FIGS. 2 and 8, when the collapsible frame is in the semi-expanded condition, the midpoint hinges 85, 90 are oriented so that the rail sections on either side of the midpoint hinges 85, 90 are straight and perpendicular to the vertical plane 115. However, the corner hinges 70, 75 and quarterpoint hinges 95, 100, 105, 110 are oriented to rotate so that, as the quarterpoint hinges 105, 110 closest to the corner hinges 70, 75 are moved toward each other along the vertical plane 115, the rails on either side of those quarterpoint hinges 105, 110 fold toward each other. As a result of the folding, the non-hinged rails 45 closest to the quarterpoint hinges 105, 110 are drawn in parallel toward the vertical plane 115. The liquid holding tank 10 is thereby temporarily reduced in size, with a corresponding decrease in liquid storage capacity. For example, the tank capacity may be reduced to approximately ¾ of its capacity in the fully expanded condition. However, the collapsible frame 5 and tank 10 can be rapidly restored to the fully expanded condition of FIG. 1 by moving the quarterpoint hinges 105, 110 away from each other.

Figure 3:
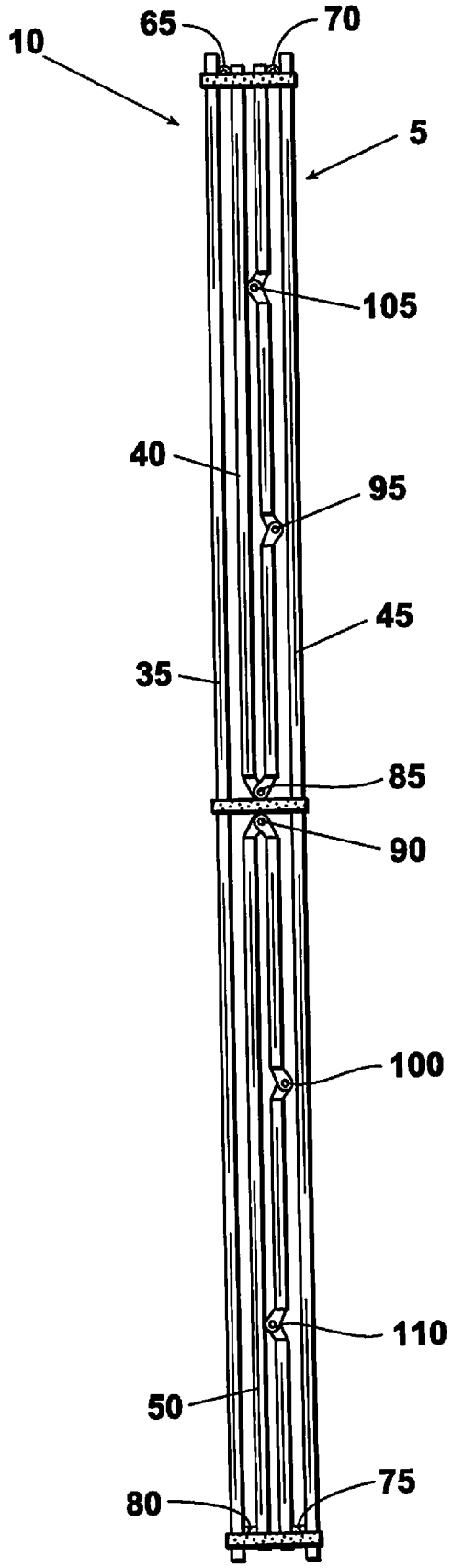
FIG. 3 is a top plan view of a preferred embodiment of the collapsible frame for a liquid holding tank in the fully collapsed condition.

Referring to FIG. 3, in the fully collapsed condition, the quarterpoint hinges 95, 100, 105, 110 are oriented so that the rail sections on either side of the quarterpoint hinges 95, 100, 105, 110 are straight. However, the midpoint hinges 85, 90 and the corner hinges 65, 70, 75, 80 are oriented to rotate so that, as the midpoint hinges 85, 90 are moved toward each other along the vertical plane 115, the hinged rails 40, 50 fold. As a result, the non-hinged rails 35, 45 are drawn in parallel toward the vertical plane 115. The collapsible frame 5 and liquid holding tank 10 are thereby reduced to the minimum size for storage.

Figure 4:
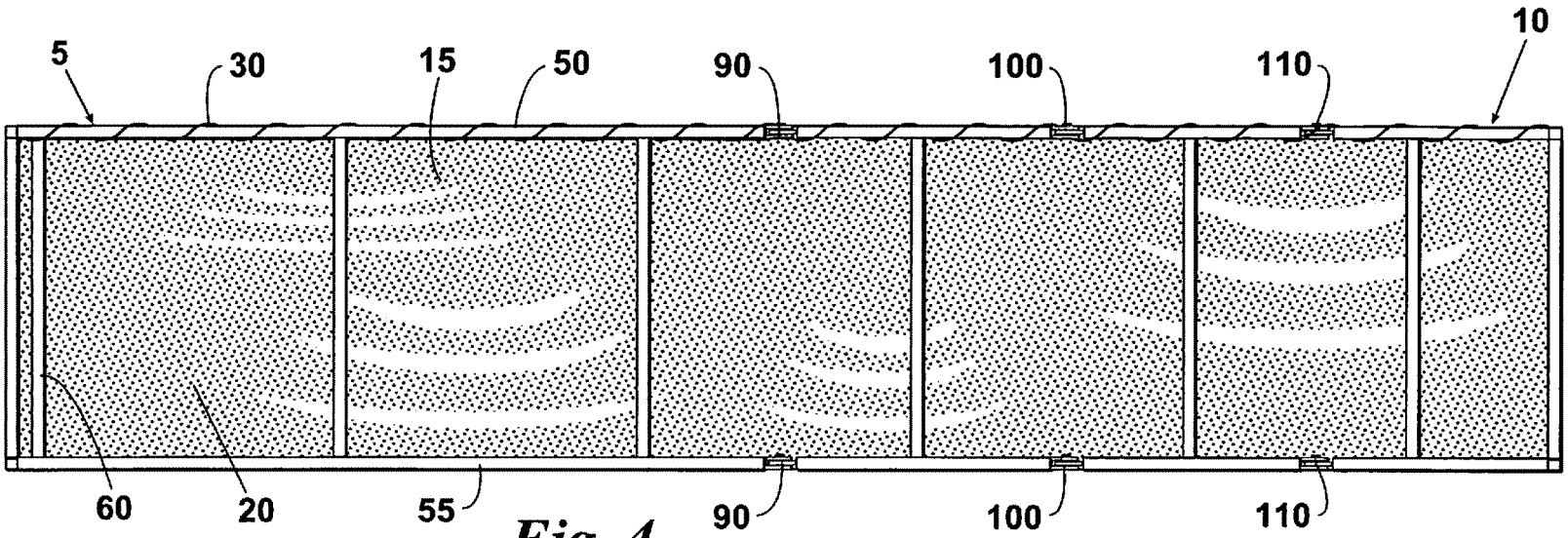
FIG. 4 is a cross-sectional view taken along the line 4-4 of FIG. 1.
Figure 5:
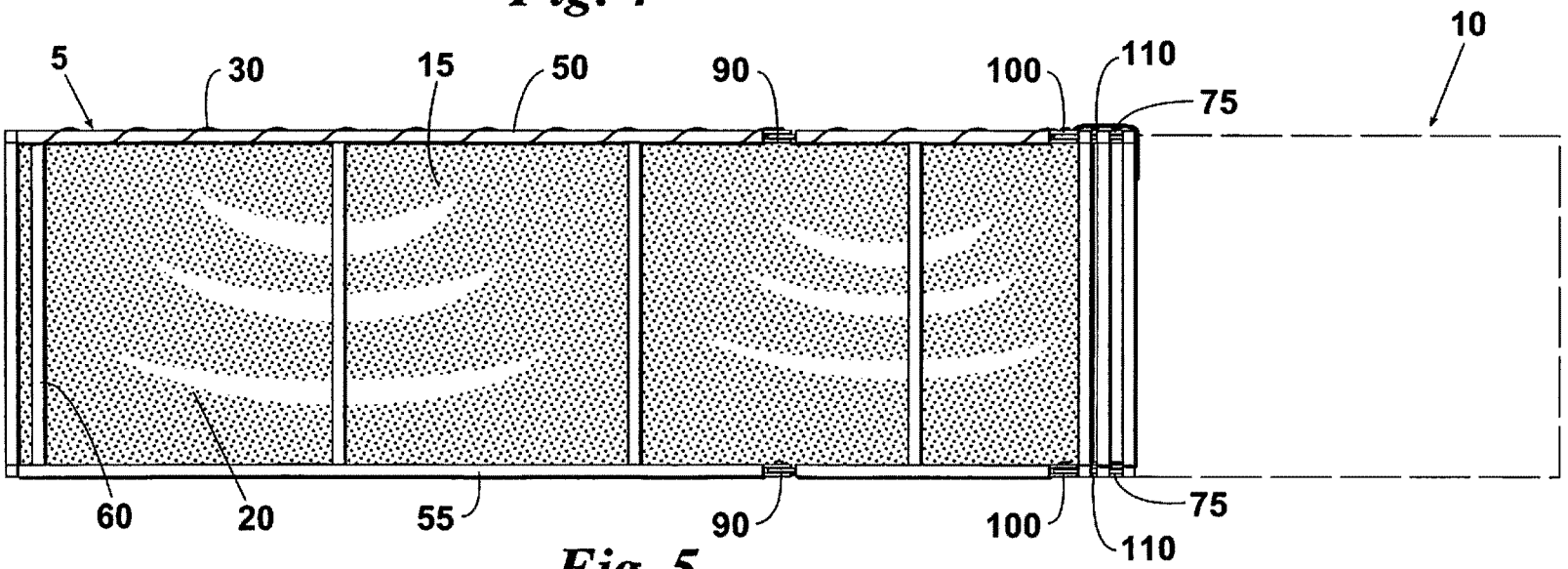
FIG. 5 is a cross-sectional view taken along the line 5-5 of FIG. 2.

FIGS. 4-5 are cross-sectional views of a side wall 20 of the tank 10 in the fully expanded and semi-expanded conditions, respectively. The side wall 20 is supported by a collapsible frame 5 having an upper rail 50, lower rail 55, and vertical struts 60. Corner hinges 75, 80 located at each end of the upper rail 50 and lower rail 55 connect the illustrated rail to the adjacent orthogonal rails. The upper and lower rails 50, 55 also have a midpoint hinge 90 and two quarterpoint hinges 100, 110. In the fully expanded condition of FIG. 4, the midpoint hinge 90 and quarterpoint hinges 100, 110 are oriented so that the rail sections on either side of the hinges are straight. This orientation makes rails 50, 55 straight, which maximizes their length, the length of the side wall 20, and the storage capacity of the tank 10. In the semi-expanded condition of FIG. 5, the midpoint hinge 90 is oriented so that the rail sections on either side of the midpoint hinge 90 are straight. However, the quarterpoint hinges 95, 100, 105, 110 and corner hinges 70, 75 are oriented so that, as the quarterpoint hinges 105, 110 closest to the corner hinges 70, 75 are moved toward each other along the vertical plane 115, the rails on either side of those quarterpoint hinges 105, 110 fold toward each other, drawing the non-hinged rail 45 in toward the vertical plane 115 and reducing tank capacity.

Figure 6:
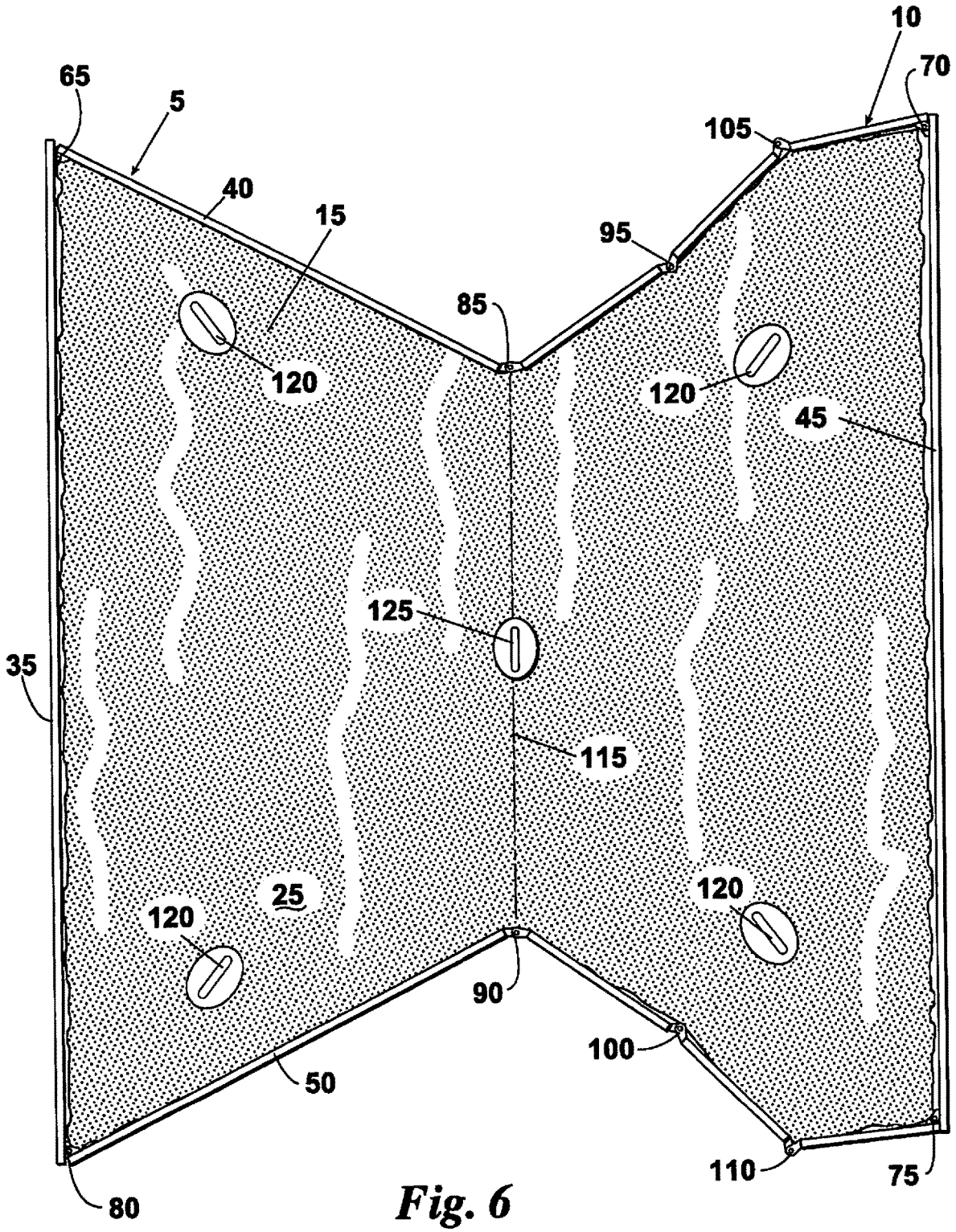
FIG. 6 is a top plan view of a preferred embodiment of the collapsible frame for a liquid holding tank in a partially collapsed condition.

FIG. 6 illustrates the collapsible frame 5 as the liquid holding tank 10 is converted from a fully expanded to a fully collapsed condition. The midpoint hinges 85, 90 have been moved together for part of the distance along the vertical plane 115, which has caused the quarterpoint hinges 95, 100, 105, 110 and corner hinges 70, 75 to rotate. As the midpoint hinges 85, 90 continue to move toward each other, the quarterpoint hinges 95, 100, 105, 110 will rotate so that the rail sections on either side of the quarterpoint hinges 95, 100, 105, 110 are straight. Folding will continue until the collapsible frame 5 is placed in the configuration shown in FIG. 3.

Referring to FIGS. 1-2, hand grips 120 may be provided on the floor panel 25 to facilitate manipulation of the tank liner 15. The hand grips 120 may be approximately 6 inches by 8 inches by 3/32 inch oblong plates supporting a handle in a trowel-like configuration. The hand grips 120 are preferably made of PVC and radio-frequency welded to the top surface of the floor panel 25. Preferably, the hand grips 120 are arranged in a zigzag pattern in relation to the vertical plane 115, which enables workers on opposite sides of the liquid holding tank 10 to move the opposite side wall hinges inwardly while lifting successive hand grips so as to simultaneously collapse the frame 5 and the tank liner 15 as the workers move toward each other.

A drain (not shown) may be provided in one side of the tank liner 15 for emptying the tank 10. To facilitate emptying the tank 10, a hand grip 125 similar to those above described may be located on the top surface of the floor panel 25 approximately on the center line of the tank 10 which is perpendicular to the vertical plane 115 and approximately 12 inches from the side wall of the tank liner 15 opposite the drain tube.

As an alternative, the collapsible frame may have orthogonally aligned midpoint hinges and a single set of quarterpoint hinges. In the fully expanded condition, the midpoint and quarterpoint hinges are oriented to rotate so that the upper and lower hinged rails are straight, thereby maximizing tank size and storage capacity. In the semi-expanded condition, the midpoint, quarterpoint, and corner hinges are oriented to rotate so that, as the quarterpoint hinges move toward each other along the vertical plane, the rails on either side of the quarterpoint hinges fold toward each other. As a result of the folding, the non-hinged rails closest to the quarterpoint hinges are drawn in parallel toward the vertical plane. The tank is thereby temporarily reduced in size, with a corresponding decrease in liquid storage capacity. For example, the tank capacity may be reduced to approximately ½ of its capacity in the fully expanded condition. However, the frame and tank can be rapidly restored to the fully expanded condition by moving the quarterpoint hinges away from each other. Other configurations of quarterpoint hinges, which would allow the tank to be placed in various semi-expanded conditions, are also possible.

Thus, it is apparent that there has been provided, in accordance with the invention, a collapsible frame for a liquid holding tank that fully satisfies the objects, aims, and advantages set forth above. While the invention has been described in conjunction with a specific embodiment thereof, it is evident that many alternatives, modifications, and variations will be apparent to those skilled in the art and in light of the foregoing description. Accordingly, it is intended to embrace all such alternatives, modifications, and variations as fall within the spirit of the claims to be appended.

What is claimed is:

1. A collapsible frame for a liquid holding tank, the frame comprising: upper and lower rails spaced by vertical struts;

eight corner hinges, one at each of four corners of said upper rails and one at each of the four corners of said lower rails;

four midpoint hinges, one at each midpoint of two opposed said upper and lower rails; and eight quarterpoint hinges, two between each corresponding pair of said midpoint and corner hinges, distances between said corner hinges and corresponding said quarterpoint hinges proximal to said corner hinges and distances between proximal said quarterpoint hinges and corresponding distal said quarter point hinges being substantially equal;

whereby the frame is in a fully collapsed condition when said midpoint hinges have been drawn toward each other and corresponding said corner, quarterpoint and midpoint hinges have been aligned, in a semi expanded orthogonal condition when said proximal quarterpoint hinges have been drawn toward each other and corresponding said corner and distal quarterpoint hinges have been drawn, together and in a fully expanded orthogonal condition when corresponding said corner, quarterpoint and midpoint hinges have been aligned.

2. The collapsible frame according to claim 1, a liquid storage capacity of the tank in said semi-expanded condition being approximately ¾ of a liquid storage capacity of the tank in said fully expanded condition.

3. The collapsible frame according to claim 1, a liquid storage capacity of the tank in said semi-expanded condition being approximately ½ of a liquid storage capacity of the tank in said fully expanded condition.

* * * * *